US006878049B2

(12) United States Patent
Heidelberger et al.

(10) Patent No.: US 6,878,049 B2
(45) Date of Patent: Apr. 12, 2005

(54) RANDOM ORBITAL SANDER

(75) Inventors: Richard A. Heidelberger, Mauldin, SC (US); Bryan D. Decker, Clarence, NY (US)

(73) Assignee: Dynabrade, Inc., Clarence, NY (US)

( * ) Notice: Subject to any disclaimer, the term of this patent is extended or adjusted under 35 U.S.C. 154(b) by 134 days.

(21) Appl. No.: 10/305,486

(22) Filed: Nov. 26, 2002

(65) Prior Publication Data

US 2004/0102145 A1 May 27, 2004

(51) Int. Cl.[7] ..... B24B 23/04

(52) U.S. Cl. ..... 451/364; 451/357; 451/355; 451/359; 277/609

(58) Field of Search ..... 451/364, 353, 451/357, 359, 344; 227/609, 646, 634–636; 384/477

(56) References Cited

U.S. PATENT DOCUMENTS

| | | | | | |
|---|---|---|---|---|---|
| 4,854,085 | A | | 8/1989 | Huber | |
| 5,445,558 | A | | 8/1995 | Hutchins | |
| 5,538,086 | A | | 7/1996 | Wright et al. | |
| 5,823,862 | A | * | 10/1998 | Heidelberger | 451/344 |
| 5,879,228 | A | | 3/1999 | Sun | |
| 5,979,000 | A | * | 11/1999 | Gansow | 15/49.1 |
| 6,004,197 | A | * | 12/1999 | Huber | 451/456 |
| 6,257,970 | B1 | * | 7/2001 | Huber | 451/357 |
| 6,343,982 | B1 | * | 2/2002 | Sun | 451/357 |

* cited by examiner

*Primary Examiner*—George Nguyen
(74) *Attorney, Agent, or Firm*—Simpson & Simpson, PLLC

(57) ABSTRACT

A pneumatically operated, random orbital sander is disclosed as having an upper seal adapted to retard the entry of dust into an exposed or lowermost motor shaft supporting bearing and a lower seal adapted to retard the entry of dust into a motor shaft mounted bearing serving to couple the motor shaft to a sanding pad or disc.

13 Claims, 4 Drawing Sheets

FIG. 1
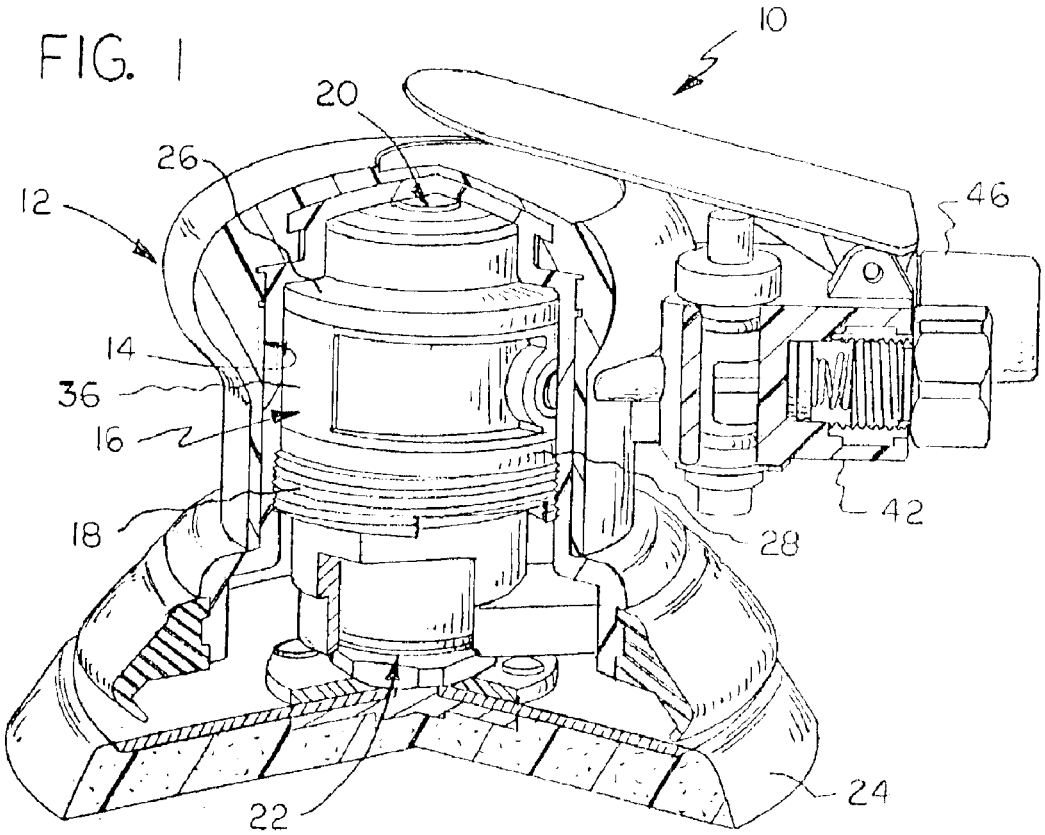
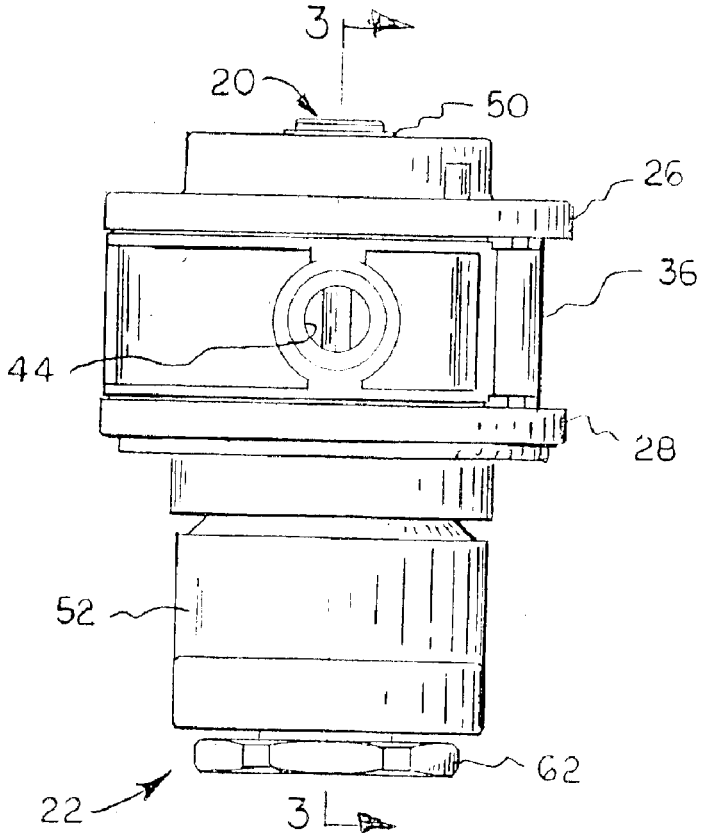
FIG. 2

FIG. 3
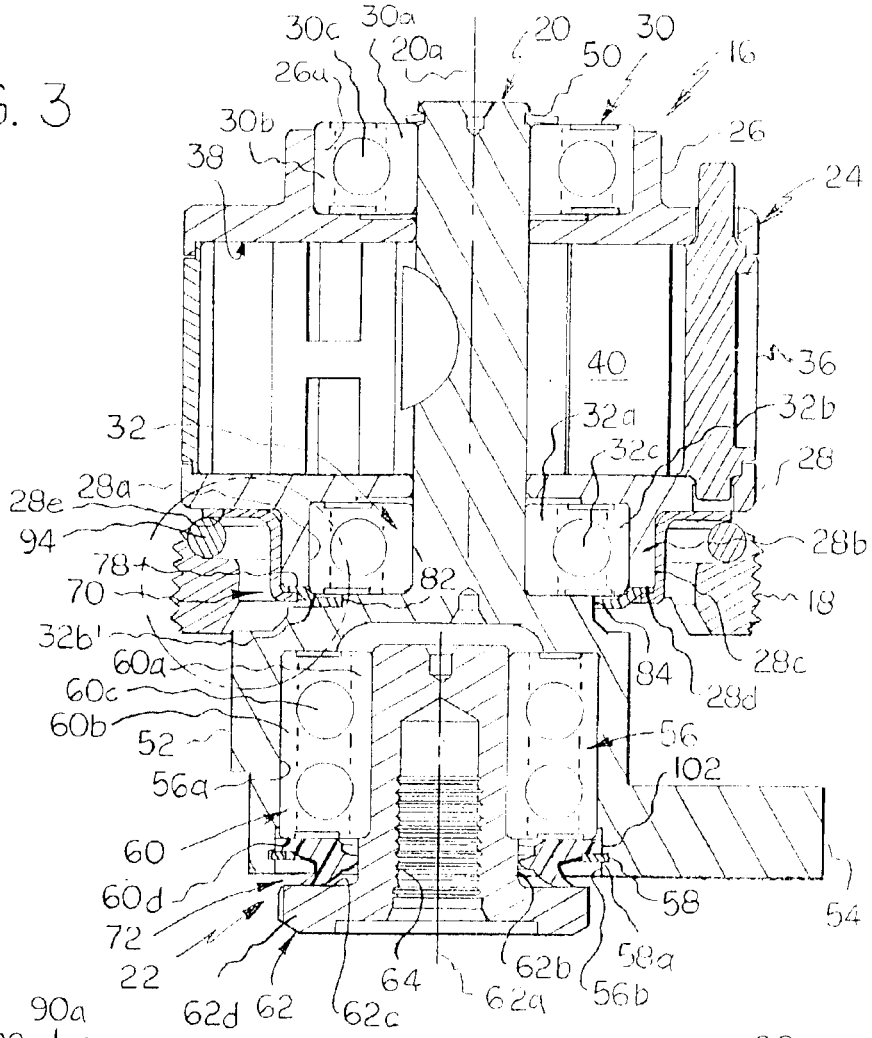
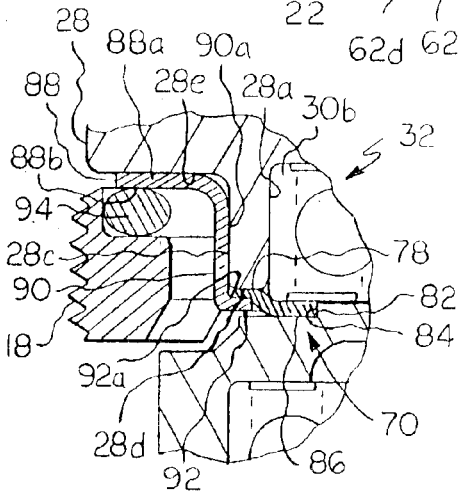
FIG. 4
FIG. 7
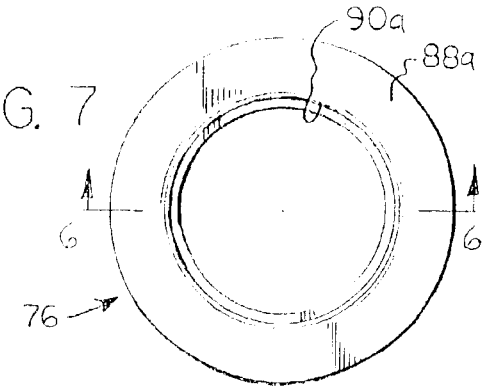
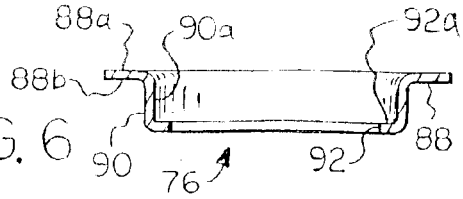
FIG. 6

RANDOM ORBITAL SANDER

BACKGROUND OF THE INVENTION

Random orbital sanders are well known and typically comprise a pneumatically operated motor having a casing suitably mounted within a manually manipulated housing and a balanced, motor shaft supported for rotation relative to the motor casing by uppermost and lowermost bearings; and a motor shaft mounted bearing serving to couple the motor shaft to a sanding pad or disc.

Prior sanders of the type generally described are known to be subject to bearing failure resulting from the egress of dust particles thereinto during use. In this respect, a lowermost motor shaft support bearing is particularly subject to failure resulting from its direct exposure to a dusty or sanding environment during use and the tendency for dust ladened air to be momentarily drawn upwardly therethrough towards the interior of the motor each time the motor is turned off. The uppermost motor support bearing is known to have a substantially longer useful operating life in that it is normally shielded from dust, due to its placement wholly within the confines of the housing of the sander.

There is no known means adopted for use in sealing the lowermost motor shaft supporting bearing against the ingress of dust particles, and thus resultant failure of such bearing can severely reduce the useful operating life of a random orbital sander, particularly when used in an environment where highly abrasive dust particles are generated.

The motor shaft mounted bearing employed to couple the drive shaft to a sanding pad or disc is also know to be subject to failure due to the ingress of abrasive dust particles, and in commonly assigned U.S. Pat. No. 4,854,085 there is described a dust seal having utility with this type of bearing. However, this dust seal has the disadvantage of being of multiple part construction.

SUMMARY OF THE INVENTION

The present invention relates to seals particularly adapted to seal bearings of random orbital sanders against the egress of dust particles, such as would otherwise shorten the useful life of such sanders.

There is disclosed two unique types of dust seals wherein a first of such seals is particularly adapted to create a seal against the ingress of dust into a lowermost bearing serving to mount a motor shaft for rotation relative to a motor casing, and a second of such seals is particularly adapted to create a seal against the ingress of dust into a motor shaft mounted bearing serving to couple the motor shaft to a sanding pad or disc to be driven thereby.

In the first seal there is provided a deformable felt washer, which is adapted to bridge between and sealing engagement with the motor shaft and a lower end or bearing supporting plate of the motor casing, and a cap adapted to be clamped against the bearing supporting plate incident to mounting of the motor casing within the sander housing, whereupon the cap serves to clamp an outer peripheral surface of the washer in sealing engagement with the supporting plate. The washer has its central or through opening sized to provide a rotary sliding seal with a cylindrical, radially outwardly facing surface of the motor shaft and is preferably adapted to have an inner peripheral surface placed in sealing engagement with an axially facing, radially and annularly extending surface of the motor shaft incident to assembly of the motor shaft with the motor casing. The washer is preferably air permeable to allow flow of pressurized air escaping from the motor across the lowermost bearing for cooling purposes.

In the second seal, there is provided a resiliently deformable sealing ring having a radially outwardly facing peripheral edge surface adapted to be positioned in sealing engagement with a radially inwardly facing surface of the motor shaft; an adjacently dispersed axially facing surface adopted to be positioned in sealing engagement with an outer race of the motor shaft supported bearing; a first resiliently deformable annular lip arranged to project radially inwardly of the sealing ring for rotary sliding engagement with a radially outwardly facing cylindrical surface of a balancer bearing shaft forming part of the coupling for the sanding pad or disc, and a second resiliently deformable, annular lip arranged to project axially of the sealing ring for rotary sliding engagement with an axially facing, radially extending surface of the balancer bearing shaft.

DRAWINGS

FIG. 1 is a prospective view of a manually manipulated, pneumatically operated sander incorporating the present invention with portions of its housing broken away;

FIG. 2 is an enlarged side elevational view of the motor and balancer assemblies with the assembly mounting or lock ring removed;

FIG. 3 is an enlarged sectional view taken generally along the line 3—3 in FIG. 2 with the mounting ring shown in unclamping position;

FIG. 4 is fragmentary view showing the mounting ring in clamping position;

FIG. 6 is a view of the upper bearing seal dust cap shown in section;

FIG. 7 is a top plan view of the upper bearing seal dust cap;

DETAILED DESCRIPTION

Figure 5:
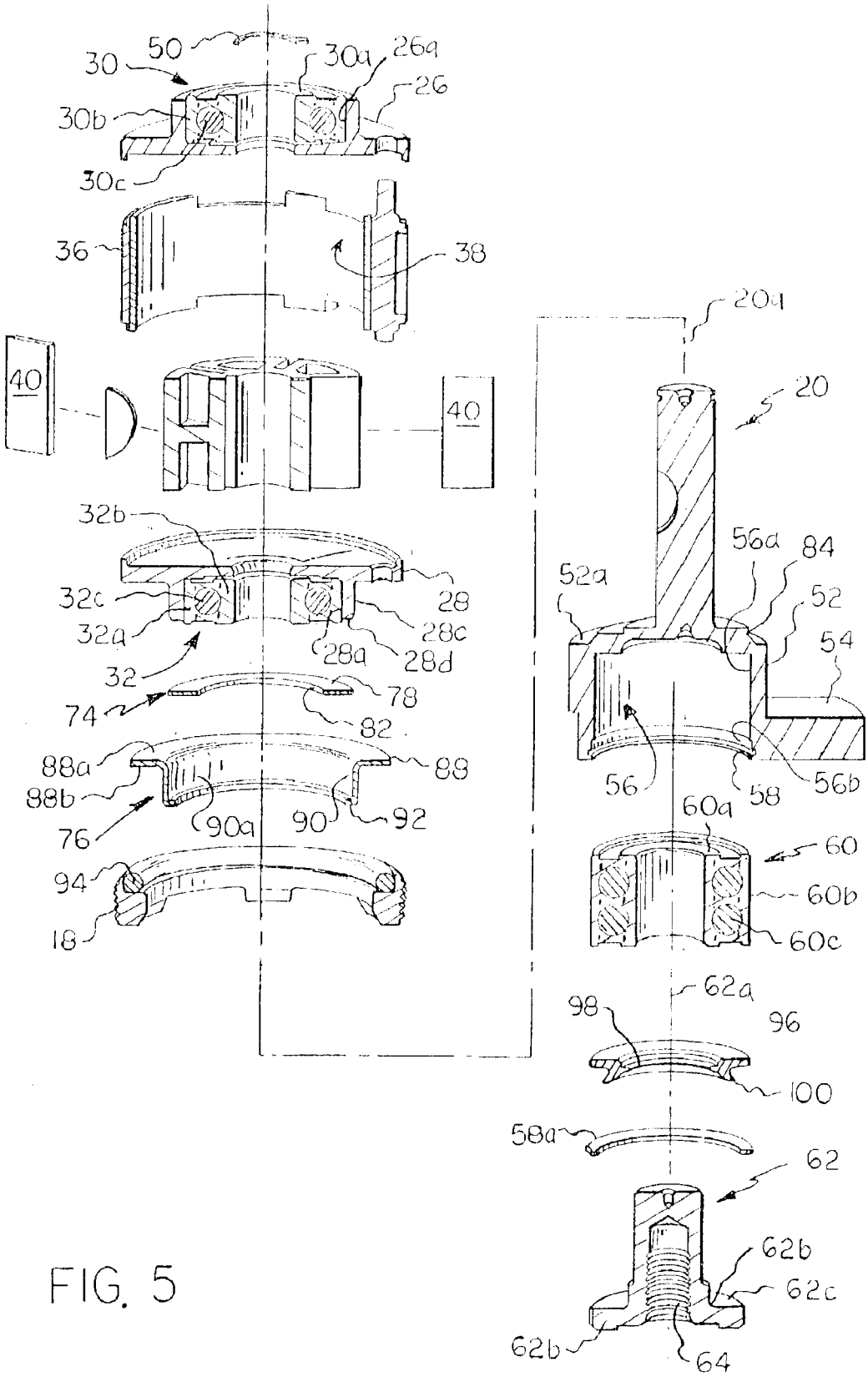
FIG. 5 is an exploded, prospective view showing elements of the balancer assembly.
Figure 8:
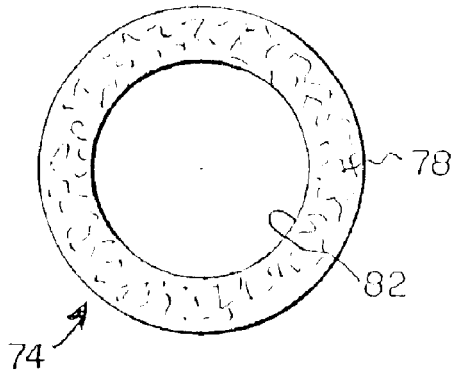
FIG. 8 is a top plan view of the upper bearing seal washer.
Figure 9:
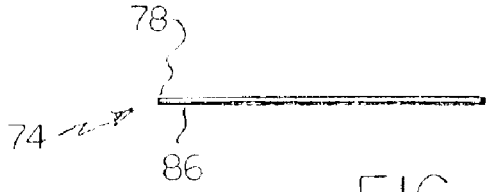
FIG. 9 is a side elevational view of the upper bearing seal washer.
Figure 11:
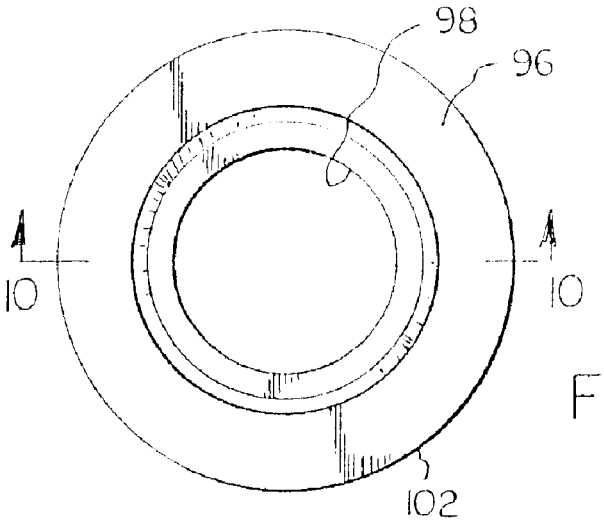
FIG. 11 is a top plan view of the lower bearing ring seal.
Figure 10:
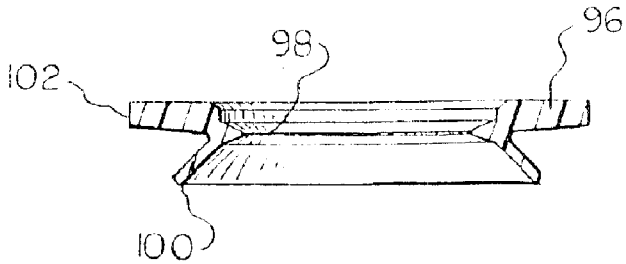
FIG. 10 is an enlarged view of the lower bearing flexible ring seal shown in section.

Reference is first made to FIG. 1, wherein a random orbital sander is designated as 10 and shown as generally including a manually manipulated housing 12 defining a downwardly opening chamber 14 sized to receive a motor 16 retained within the chamber by a lock or mounting ring 18 threadably fixed to the housing and including a balanced motor driven shaft 20; and a coupling 22 for mounting a sanding pad or disc 24 for orbital movement relating to the motor shaft.

Motor 16 is shown in FIGS. 1–3 as generally comprising a casing defined by upper and lower end or bearing support plates 26 and 28 having upwardly and downwardly facing recesses 26*a* and 28*a* for mounting uppermost and lowermost bearings 30 and 32 serving to support motor shaft 20 for rotation about a first axis 20*a*, and an annular side wall 36 cooperating with the end plates to bound a motor chamber 38 receiving a plurality of rotor blades 40 for rotation with the motor shaft. Recess 28*a* is radially bounded by a cylindrical side wall 28*b* having an outwardly facing cylindrical side wall surface 28*c* and an axially facing, annular end wall surface 28*d*. End plate 28 is also provided with an axially facing annular surface 28*e* extending outwardly of side wall surface 28*c*.

Bearings 30 and 32 are formed, respectively, with inner and outer races 30*a*, 32*a* and 30*b*, 32*b*; and a plurality of ball or roller elements 30*c*, 32*c*. Chamber 38 is arranged for flow communication with a suitable source of fluid, such as air, under pressure via a valve controlled housing inlet passage 42 and a chamber inlet 44 and with a housing discharge passage 46 via a chamber discharge openings, not shown.

Motor shaft 20 is suitably fixed for rotation with inner races 30*a* and 32*a*, and maintained in assembled condition relative to end plates 26 and 28 and side wall 36 by snap ring retainer 50.

Motor shaft 20 is best shown in FIGS. 3 and 5 as having an enlarged lower end 52, which includes a shaft balancing weight 54 and defines a downwardly opening cylindrical cavity or chamber 56. Cavity 56 is shown in FIG. 3 as being stepped to define an inner cylindrical recess surface 56*a* and a radially enlarged outer cylindrical recess surface 56*b* having an annular recess 58 for receiving a snap ring retainer 58*a*.

Coupling 22 is best shown in FIG. 3 as including a bearing 60 formed with inner and outer races 60*a* and 60*b*, and ball or roller elements 60*c*, and a balancer bearing shaft 62, which is supported by inner bearing race 60*a* for rotation about a second axis 62*a* disposed parallel to motor shaft axis 20*a*.

Bearing outer race 60*b* is sized to be slide fitted within cavity recess surface 56*a* and preferably retained therein by a suitable adhesive, such as Loctite. Balancer bearing shaft 62 is preferably press fit within the inner race 60*a*, and, if desired, bonded thereto by a suitable adhesive, such as Loctite. Sanding pad 24 may be suitably, removably fixed to balancer bearing shaft 62, such as by a fastener, not shown, threadably received within shaft opening 64 aligned with axis 62*a*.

Balancer shaft 62 is shown as having an outwardly facing cylindrical surface 62*b* and axially facing annular surface 62*c* defined by an enlarged head portion 62*d*.

As thus far described, sander is of known construction and generally disclosed, as by way of example, by commonly assigned U.S. Pat. Nos. 4,854,085 and 5,538,086.

In accordance with the present invention, an otherwise conventional orbital sander is provided with a first seal 70 intended to block ingress of dust particles into lowermost motor shaft support bearing 32, and a second seal 72 intended to prevent the ingress of dust particles into motor shaft mounted bearing 60.

Seal 70 is shown in FIGS. 3–9 as being of two part construction including a deformable washer 74 preferably formed of a 100% polyester felt material, and a cap 76 preferably formed of Nylon. Washer 74 is preferably air permeable, so as to allow the flow of pressurized air escaping from motor chamber 38 across bearing 32 for cooling purposes.

Washer 74 is sized such that its outer diameter is sufficient to provide an annular, axially facing sealing surface 78 adapted to engage with end wall surface 28*d* of lower end plate 28 radially outwardly of bearing recess 28*a* and its inner diameter is such that there is provided a radially inwardly facing edge surface 82 disposed for rotary sliding engagement with a radially outwardly facing cylindrical surface 84 of the motor shaft. In its as formed state, washer 74 has a flat rim portion with its oppositely facing annular sealing and clamping surfaces 78 and 86, respectively, essentially parallel to one another. In this construction, end wall surface 28*d* becomes a sealing surface and end plate annular surface 28*e* becomes a clamping surface.

In the illustrated construction, an axially facing surface 52*a* of motor shaft lower end 52, which extends radially of cylindrical surface 84, extends annularly of axis 20*a* through less than 360°, due to space limitations determined by the available distance between axis 20*a* and second axis 62*a*. However, if space allows, it is preferable to extend surface 52*a* through 360° in order to provide a further annular seal between surface 52*a* and washer clamping surface 86.

Cap 76 is best shown in FIGS. 3–7 and including radially extending annular flange portion 88, a cylindrical portion 90 arranged to depend from the radially inner edge of portion 88, and an annular flange portion 92 arranged to project radially inwardly from the lower edge of portion 90. Flange portion 88 has oppositely facing and essentially parallel first and second annular cap clamping surfaces 88*a* and 88*b* sized to extend radially outwardly of end plate side wall surface 28*c* for engagement with axially facing outer annular clamping surface 28*e* of end plate 28 and an o-ring 94 carried by lock ring 18. Cylindrical portion 90 has a radially inwardly facing surface 90*a* sized to be slidably supported by end plate side wall surface 28*c*. Cap flange portion 92 provides a third clamping surface 92*a*.

It will be understood by referring to FIGS. 1 and 3 that upon threadably connecting lock ring 18 to housing 12 for purposes of mounting motor, o-ring 94 is adapted to be brought into clamping engagement with second cap clamping surface 88*b* for purposes of clamping first cap clamping surface 88*a* against end plate clamping surface 28*e* with the result that third cap clamping surface is drawn upwardly into clamping engagement with washer clamping surface 86 and washer scaling surface 78 forced into scaling engagement with end plate end wall surface 28*d*. In the arrangement shown in the drawings the lower end 32*b* of outer race 32*b* projects slightly outwardly of recess 28*a* beyond end plate end wall surface 28*d* with the result that washer 74 is deformed, as shown in FIGS. 3 and 4, as lock ring 18 is threaded into housing 12, and surface 78 is also placed in tight sealing engagement with outer bearing lower end 32*b*. With this construction, washer 74 serves to bridge between end plate 28 and motor shaft 20 and create a dust seal tending to prevent the ingress of dust particles to lower bearing 32.

During operation of sander 10, pressurized air tends to escape from motor chamber 38 through the annular path defined by lower end plate 28 and motor shaft 20, and due to the air permeable nature of washer 74, is permitted to flow axially of bearing 32 in order to cool such bearing. Washer 74, also permits the reverse flow of air across bearing 32 each time motor 16 is turned off, but prevents passage of dust into the bearings which would otherwise occur in the absence of such washer.

Second seal 72 is preferably in the form of a resiliently deformable ring fabricated of a high temperature, chemical and abrasion resistant material, such as 70 duro-carboxyladed nitrile material with balancer bearing shaft surfaces 62*b* and 62*c* serving to define cooperating sealing surfaces.

The sealing ring is defined by a radially extending annular flange 96, a radially inwardly projecting flexible annular first sealing lip 98 and an axially projecting flexible annular second sealing lip 100. As best shown in FIG. 3 the elements of the sealing ring are sized such that first seal lip 98 is resiliently deformed for rotary sealing engagement with balancer shaft surface 62*b* and second sealing lip is deformed for rotary sealing engagement with balancer shaft surface 62*c* incident to placement of the balancer shaft within bearing 60. Also, it will be understood that the thickness and diameter of flange 96 is such that installation of retainer 58*a* serves to clamp flange portion 96 in sealing engagement with a lower annular surface 60*d* of outer bearing race 60*b* and preferably also to resiliently deform the flange portion sufficiently to force its radially outwardly facing edge surface 102 into sealing engagement with recess surface 56*b* intermediate outer race 60*b* and retainer 58*a*.

With this construction, the sealing ring bridges between balancer bearing shaft 62 and motor shaft 20 and serves to create a dust seal tending to prevent ingress of dust particles into further bearing 60.

What is claimed is:

1. A random orbital sander comprising:

a manually manipulated housing having a downward opening chamber and pressurized fluid inlet and fluid outlets communicating with said chamber;

a pressurized fluid operated motor including a motor casing arranged within said chamber and a counter balanced motor shaft depending from said casing and supported for driven rotation about a first axis by upper and lower casing mounted bearings incident to the introduction of pressurized fluid into said casing from said chamber;

a first sealing means bridging between said motor shaft and said casing for providing a dust seal for said lower bearing;

coupling means for drivingly connecting a sanding pad to said motor shaft for rotation about a second axis disposed parallel to said first axis, said coupling means including a further bearing and a balancer bearing shaft supported by said further bearing for rotation about said second axis; and a second sealing means bridging between said balancer bearing shaft and said motor shaft for providing a dust seal for said further bearing.

2. A sander according to claim 1, wherein said casing includes an end plate having an annular, axially facing clamping surface and a cylindrical wall portion bounding a recess for receiving said lower bearing, said wall portion having an annular axially facing end wall sealing surface; said motor shaft has a radially outwardly facing cylindrical sealing surface; and said first sealing means includes a deformable sealing washer having a radially inwardly facing annular edge surface arranged for rotary sealing engagement with said cylindrical sealing surface of said motor shaft and an outer annular rim portion having axially oppositely facing annular washer sealing and clamping surfaces, and a cap for clamping said washer sealing surface against said end wall sealing surface of said end plate, said cap having a radially outwardly facing annular flange having axially oppositely facing first and second cap clamping surfaces and a radially inwardly facing annular flange having an axially facing third annular cap clamping surface, and clamping means engaging with said second cap clamping surface for clamping said first cap clamping surface against said clamping surface of said end plate and placing said third cap clamping surface in clamping engagement with said washer clamping surface and said washer sealing surface in sealing engagement with said end wall sealing surface of said end plate.

3. A sander according to claim 2, wherein said clamping means additionally serves to retain said motor casing within said chamber.

4. A sander according to claim 2, wherein said lower bearing includes inner and outer races fixed to said casing and motor shaft, respectively, and said outer race has a portion thereof projecting outwardly from said recess of said end plate beyond said end wall sealing surface, and said washer sealing surface sealingly engages with said portion of said outer race.

5. A sander according to claim 4, wherein said clamping means additionally serves to retain said motor casing within said chamber.

6. A sander according to claim 2, wherein said motor shaft defines a downwardly opening recess for receiving said further bearing and being bounded by a retaining means receiving recess, said bearing receiving recess of said motor shaft defining a radially inwardly facing cylindrical sealing surface disposed axially inwardly of said retaining means receiving recess, said further bearing including an outer race and an inner race, said outer race of said further bearing being fixed within said bearing receiving recess of said motor shaft and defining an axially facing clamping surface, said balancer bearing shaft being fixed to said inner race of said further bearing and having a radially outwardly facing cylindrical sealing surface and an axially facing annular sealing surface, and said second sealing means includes a resiliently deformable sealing ring, said ring having a radially extending annular flange portion, a radially inwardly projecting annular first sealing lip joined to said flange portion and an axially projecting annular second sealing lip joined to said flange portion, and a retaining means insertable in to said retaining means receiving recess and cooperating with said clamping surface of said outer race of said further bearing to resiliently deformably clamp said flange portion of said sealing ring there-between, and retain said first and second sealing lips in resiliently deformable engagement with said cylindrical sealing surface and axially facing sealing surface of said balancer bearing shaft respectively.

7. A sander according to claim 6, wherein said recess of said motor shaft defines an inwardly facing cylindrical surface arranged axially intermediate said retaining means receiving recess and said clamping surface of said outer race of said further bearing and said flange of said sealing ring has a radially outwardly facing edge surface sized to expand into sealingly engagement with said cylindrical surface of said recess incident to clamping of said flange portion of said ring between said clamping surface of said outer race of said further bearing and said retaining means.

8. A sander comprising:

a manually manipulated housing having a downward opening chamber and pressurized fluid inlet and fluid outlets communicating with said chamber;

a pressurized fluid operated motor including a motor casing arranged within said chamber and a counter balanced motor shaft depending from said casing and supported for driven rotation about a first axis by upper and lower casing mounted bearings incident to the introduction of pressurized fluid into said casing from said chamber;

a first sealing means bridging between said motor shaft and said casing for providing a dust seal for said lower bearing;

coupling means for drivingly connecting a sanding pad to said motor shaft for rotation about a second axis disposed parallel to said first axis;

said casing includes an end plate having an annular, axially facing clamping surface and a cylindrical wall portion bounding a recess for receiving said lower bearing, said wall portion having an annular axially facing end wall sealing surface; said motor shaft has a radially outwardly facing cylindrical sealing surface; and said first sealing means includes a deformable sealing washer having a radially inwardly facing annular edge surface arranged for rotary sealing engagement with said cylindrical sealing surface of said motor shaft and an outer annular rim portion having axially oppositely facing annular washer sealing and clamping surfaces, and a cap for clamping said washer sealing surface against said end wall sealing surface of said end plate, said cap having a radially outwardly facing annular flange having axially oppositely facing first and second cap clamping surfaces and a radially inwardly facing annular flange having an axially facing third annular cap clamping surface, and clamping means engaging with said second cap clamping surface for clamping said first cap clamping surface against said clamping surface of said end plate and placing said third cap clamping surface in clamping engagement with said washer clamping surface and said washer sealing surface in sealing engagement with said end wall sealing surface of said end plate.

9. A sander according to claim 8, wherein said clamping means additionally serves to retain said motor casing within said chamber.

10. A sander according to claim 8, wherein said lower bearing includes inner and outer races fixed to said casing and motor shaft, respectively, and said outer race has a portion thereof projecting outwardly from said recess of said end plate beyond said end wall sealing surface, and said washer sealing surface sealingly engages with said portion of said outer race.

11. A sander according to claim 10, wherein said clamping means additionally serves to retain said motor casing within said chamber.

12. A sander comprising:

a manually manipulated housing having a downward opening chamber and pressurized fluid inlet and fluid outlets communicating with said chamber;

a pressurized fluid operated motor including a motor casing arranged within said chamber and a counter balanced motor shaft depending from said casing and supported for driven rotation about a first axis by upper and lower casing mounted bearings incident to the introduction of pressurized fluid into said casing from said chamber;

coupling means for drivingly connecting a sanding pad to said motor shaft for rotation about a second axis disposed parallel to said first axis, said coupling means including a further bearing and a balancer bearing shaft supported by said further bearing for rotation about said second axis; and a sealing means bridging between said balancer bearing shaft and said motor shaft for providing a dust seal for said further bearing;

said motor shaft defines a downwardly opening recess for receiving said further bearing and being bounded by a retaining means receiving recess, said bearing receiving recess of said motor shaft defining a radially inwardly facing cylindrical sealing surface disposed axially inwardly of said retaining means receiving recess, said further bearing including an outer race and an inner race, said outer race of said further bearing being fixed within said bearing receiving recess of said motor shaft and defining an axially facing clamping surface, said balancer bearing shaft being fixed to said inner race of said further bearing and having a radially outwardly facing cylindrical sealing surface and an axially facing annular sealing surface, and said sealing means includes a resiliently deformable sealing ring, said ring having a radially extending annular flange portion, a radially inwardly projecting annular first sealing lip joined to said flange portion and an axially projecting annular second sealing lip joined to said flange portion, and a retaining means insertable in to said retaining means receiving recess and cooperating with said clamping surface of said outer race of said further bearing to resiliently deformably clamp said flange portion of said sealing ring therebetween, and retain said first and second sealing lips in resiliently deformable engagement with said cylindrical sealing surface and axially facing sealing surface of said balancer bearing shaft respectively.

13. A sander according to claim 12, wherein said recess of said motor shaft defines an inwardly facing cylindrical surface arranged axially intermediate said retaining means receiving recess and said clamping surface of said outer race of said further bearing and said flange of said sealing ring has a radially outwardly facing edge surface sized to expand into sealingly engagement with said cylindrical surface of said recess incident to clamping of said flange portion of said ring between said clamping surface of said outer race of said further bearing and said retaining means.

* * * * *